US008047808B2

(12) United States Patent
Kondo

(10) Patent No.: US 8,047,808 B2
(45) Date of Patent: Nov. 1, 2011

(54) GEYSER PUMP

(75) Inventor: Masao Kondo, Dublin, OH (US)

(73) Assignee: Geyser Pump Tech, LLC, Dublin, OH (US)

( * ) Notice: Subject to any disclaimer, the term of this patent is extended or adjusted under 35 U.S.C. 154(b) by 1233 days.

(21) Appl. No.: 11/654,448

(22) Filed: Jan. 17, 2007

(65) Prior Publication Data

US 2007/0166171 A1 Jul. 19, 2007

Related U.S. Application Data

(60) Provisional application No. 60/759,311, filed on Jan. 17, 2006.

(51) Int. Cl.
*F04F 1/08* (2006.01)

(52) U.S. Cl. ..... 417/137; 417/108; 417/118

(58) Field of Classification Search ..... 417/108, 417/118, 54, 90, 91, 109, 116, 137; 210/263, 210/150, 262, 257.1, 532.1, 532.2
See application file for complete search history.

(56) References Cited

U.S. PATENT DOCUMENTS

| | | | | | |
|---|---|---|---|---|---|
| 753,045 | A * | 2/1904 | Cooper | 166/267 |
| 1,339,137 | A * | 5/1920 | Rogers | 417/108 |
| 1,574,783 | A * | 3/1926 | Beth | 119/263 |
| 3,133,507 | A * | 5/1964 | Van Der Ster | 417/208 |
| 4,293,506 | A * | 10/1981 | Lipert | 261/77 |
| 4,780,217 | A * | 10/1988 | Petersen | 210/758 |
| 4,789,503 | A * | 12/1988 | Murphy | 261/77 |
| 5,312,232 | A * | 5/1994 | Horton et al. | 417/108 |
| 5,358,357 | A * | 10/1994 | Mancini et al. | 405/128.2 |
| 5,777,214 | A * | 7/1998 | Thompson et al. | 73/61.59 |
| 6,042,342 | A * | 3/2000 | Orian | 417/207 |
| 6,162,020 | A | 12/2000 | Kondo | |
| 6,357,530 | B1 * | 3/2002 | Kennedy et al. | 166/369 |
| 6,976,497 | B2 * | 12/2005 | Gridley | 137/14 |
| 7,494,534 | B2 * | 2/2009 | Fukagawa et al. | 96/168 |

* cited by examiner

*Primary Examiner* — Devon C Kramer
*Assistant Examiner* — Leonard Weinstein

(57) ABSTRACT

A system pumps liquid. The system includes a compressed air source and a pump for vertically moving the liquid upward. The pump is powered by the compressed air source. The pump includes a first container, a second container disposed interior to the first container, and a U-shaped tube disposed interior to the first and second containers. The compressed air source supplies compressed air to the U-shaped tube at a vertical portion of the U-shaped tube.

12 Claims, 6 Drawing Sheets

GEYSER PUMP

RELATED APPLICATION

This application claims priority from U.S. provisional patent application Ser. No. 60/759,311, filed on Jan. 17, 2006, the subject matter of which is incorporated herein by reference.

TECHNICAL FIELD

The present invention states that the field of the invention is mechanical pumps, and more particularly, a geyser pump.

DESCRIPTION OF THE PRIOR ART

In a conventional airlift pump 9 (FIG. 1), air is supplied from a compressed air source 1 connected to an input end 3 of an air supply line 4. An output end 5 of the air supply line 4 is connected through a port 6 to a lower end of a riser tube 8. Port 6 is submerged below a liquid level LL to a depth S in a liquid L contained in a vessel V. A lower intake port 7 of the riser tube 8 is located a distance D above a bottom wall 11 of vessel V. Air flowing through the liquid L in the portion of the riser tube 8 above the port 6 creates an air-liquid mix ALM less dense than the liquid L. Thus the air-liquid mix ALM rises and discharges through an output port 10 of the riser tube. Liquid L is transferred from a liquid supply 2 to vessel V.

The flow of air through the air supply line 4 and port 6 typically remains constant. Thus air-liquid mix ALM discharged by the conventional airlift pump 9 through the output port 10 is continuous, provided liquid level LL does not fall below port 6.

Another conventional airlift pump may increase the discharge by intermittent air supply to the riser, as shown in FIG. 2. An airlift pump system 40 is supplied with air from an air source 14 connected to an input 15 of an air supply line 16. An output port 20 is connected to a closed upper end 18 of an air tank 32. The air tank 32 has a cylindrical configuration with a bottom end 38 open to liquid L. A cylindrical riser tube 34 has an elbow 28 with an upper vertical intake end 22 and an intake port 24 and a lower horizontal discharge end 26 with a discharge port 30 connected to a lower portion of riser tube 34. The riser tube 34 extends upward through a suitably tight opening 36 in the closed upper end 18 of the air tank 32 to an output 42.

The airlift pump system 40 may be installed in a grit chamber or other vessel having a liquid supply 17 and containing wastewater liquid L to be pumped through an intake port 40 of riser tube 34. Increasing the rate of output of the conventional airlift pump system 40 in such an application is desirable.

SUMMARY OF THE INVENTION

A system in accordance with the present invention pumps liquid. The system includes a compressed air source and a pump for vertically moving the liquid upward. The pump is powered by the compressed air source. The pump includes a first container, a second container disposed interior to the first container, and a U-shaped tube disposed interior to the first and second containers. The compressed air source supplies compressed air to the U-shaped tube at a vertical portion of the U-shaped tube.

BRIEF DESCRIPTION OF THE DRAWINGS

The foregoing and other features of the present invention will become apparent to those skilled in the art to which the present invention relates upon reading the following description with reference to the accompanying drawings, in which.

DESCRIPTION OF AN EXAMPLE EMBODIMENT

Figure 1:
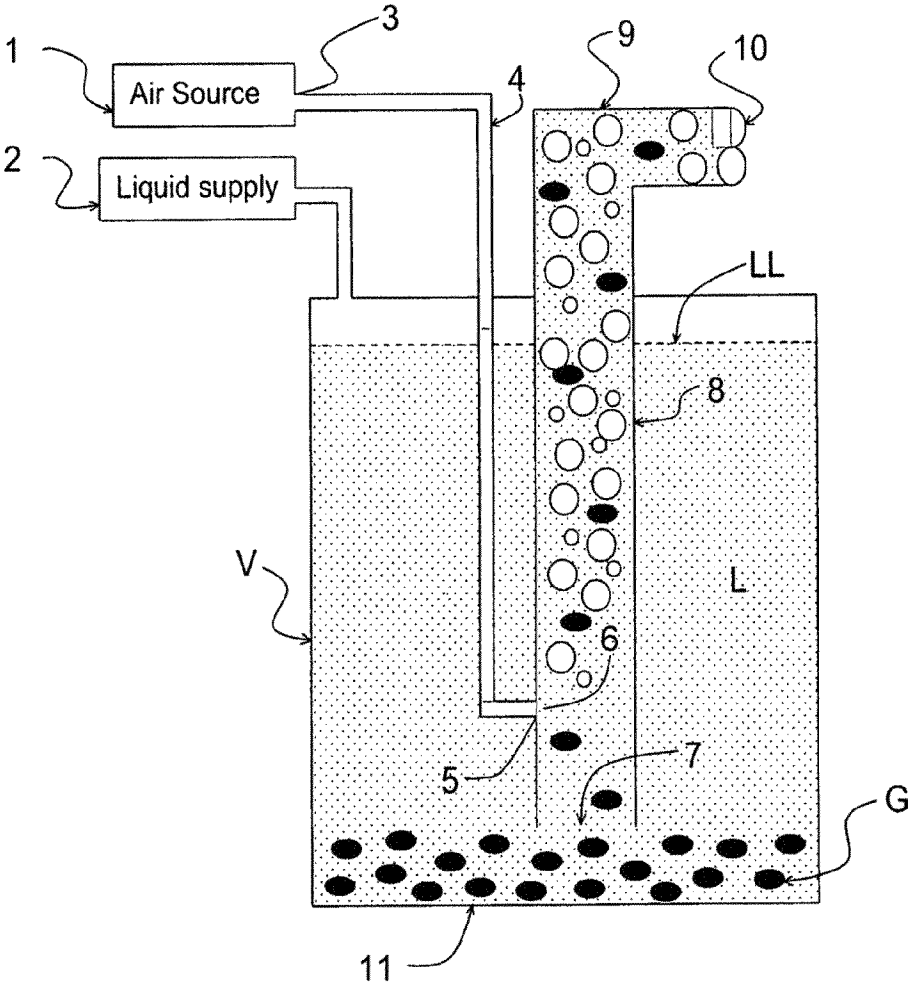
FIG. 1 PRIOR ART
FIG. 1 is a schematic representation of a conventional pump system.
Figure 3:
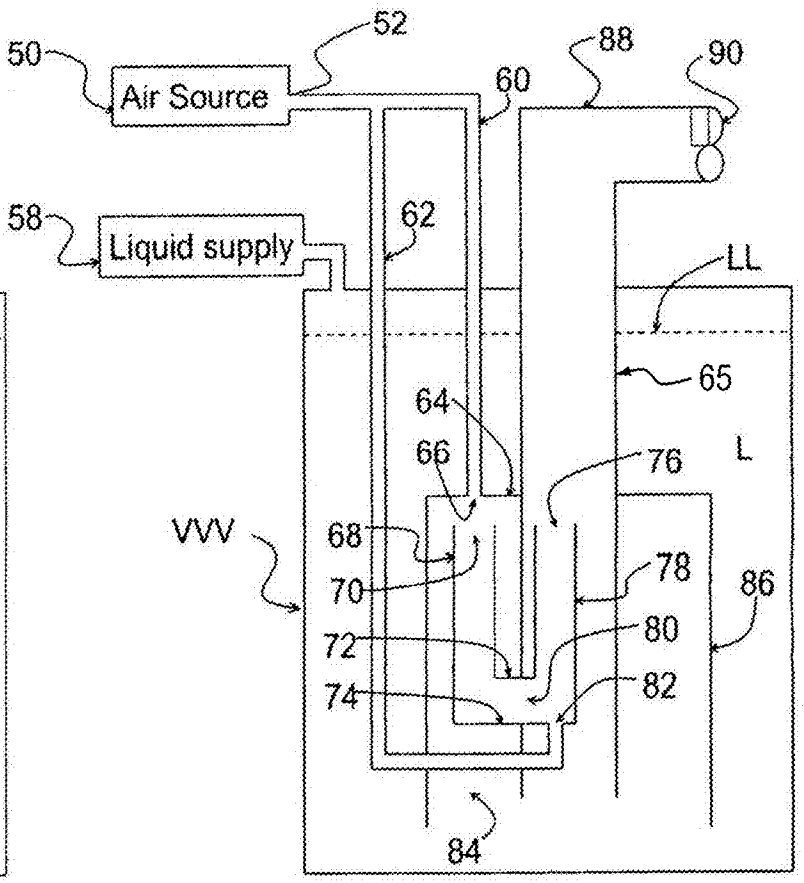
FIG. 3 is a schematic representation of an example pump system in accordance with the present invention.

An airlift pump system 88 includes a vessel VVV supplied with liquid from a liquid supply 58 and with air from an air source 50 connected to an input 52 of a first air supply line 60 and a second air supply line 62. A first output port 66 of the first air supply line 60 is connected to a closed upper end 64 of an air tank 86. The air tank 86 has a cylindrical configuration with a bottom end 84 open to liquid L. A cylindrical riser tube 65 has a U-shaped elbow 74 with an upper vertical intake end 68 and an intake port 70, a lower horizontal portion 72 defining a port 80 penetrating a side wall of the riser tube 65, and an upper vertical discharge end 78 with a discharge port 76 disposed within the riser tube 65. A second output port 82 of the second air supply line 62 is connected to the lower horizontal portion 72 of the riser tube 65. Note that the second air supply line 62 may be omitted if the superficial density of the liquid L is less than 1.5. The riser tube 65 extends upward through a suitably tight opening in the closed upper end 64 of the air tank 86 to a discharge port 90.

Figure 5:
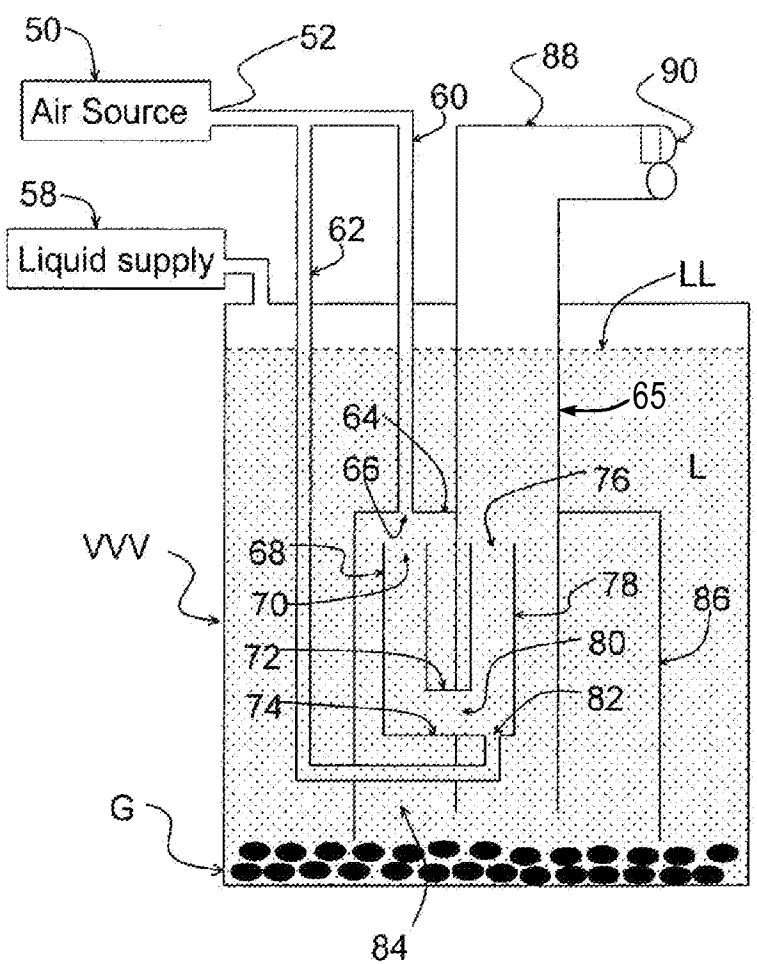
FIG. 5 is a schematic representation of the example pump system of FIG. 3 under another operating condition.

FIG. 5 shows the airlift pump system 88 having grit accumulated at the bottom of the vessel VVV.

Figure 6:
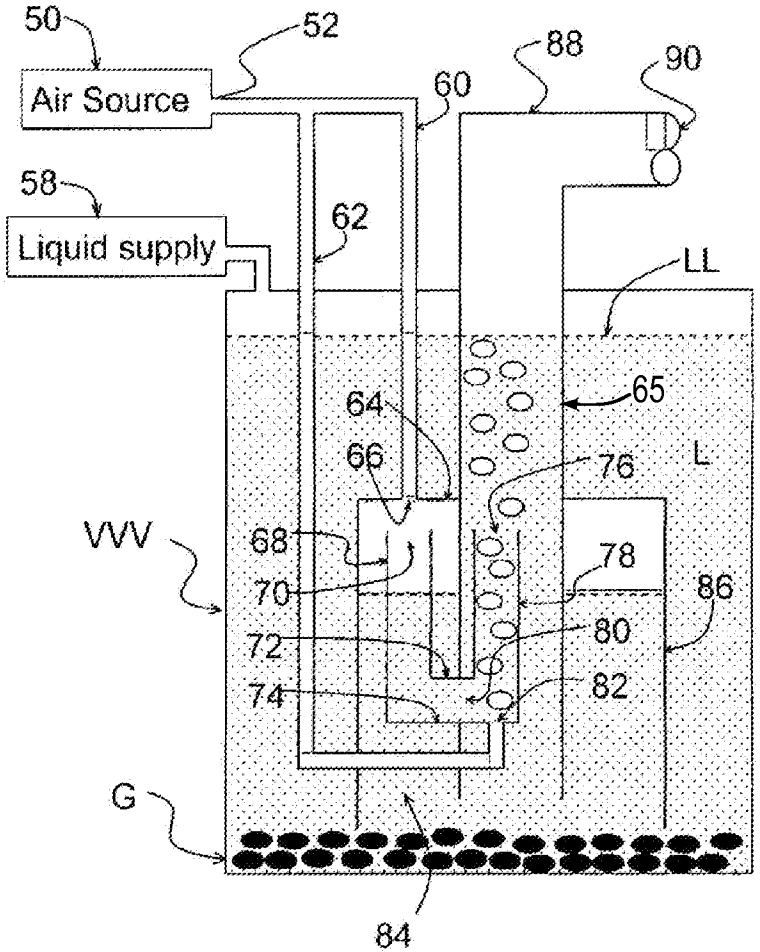
FIG. 6 is a schematic representation of the example pump system of FIG. 3 under still another operating condition.

FIG. 6 shows the airlift pump system 88 with air supplied through the first air supply line 60 and the second air supply line 62 where air from the first air supply line 60 is accumulated at the upper portion of the air tank 86. Air from the second output port 82 of the second supply line 62 creates a series of air bubbles within the riser tube 65.

Figure 7:
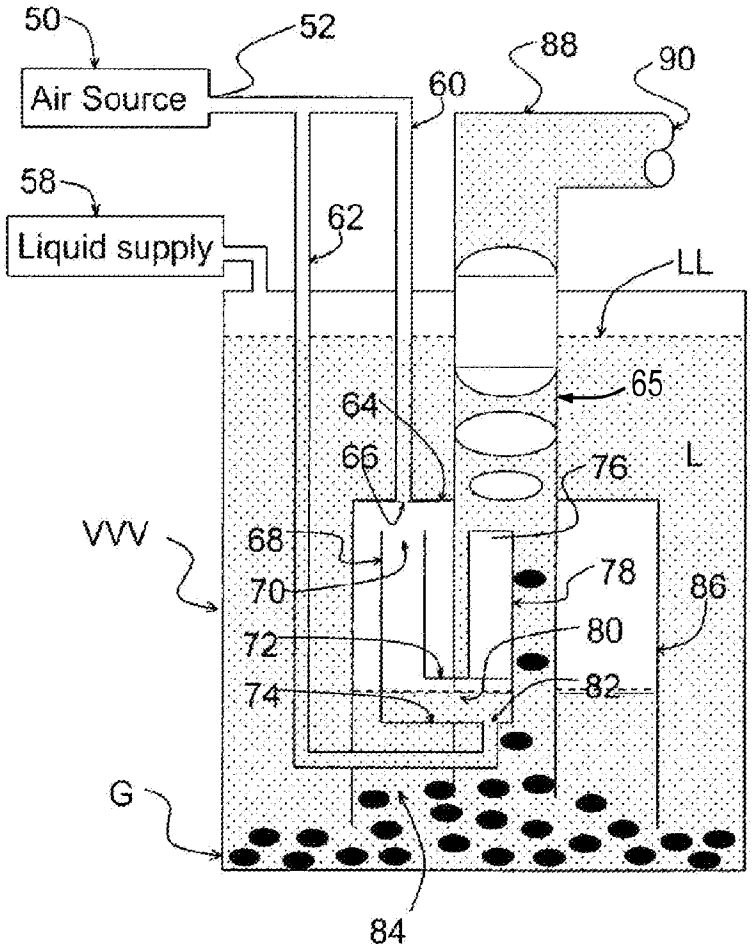
FIG. 7 is a schematic representation of the example pump system of FIG. 3 under yet another operating condition.

FIG. 7 shows the airlift pump system 88 with a liquid level in the air tank 86 and riser tube 65 below the uppermost part or the horizontal portion 72.

Thus, the air accumulated in the air tank 86 may be directly released through the discharge port 76 of the discharge end 78 of the U-shaped elbow 74 within the riser tube 65 as a large bubble.

Figure 2:
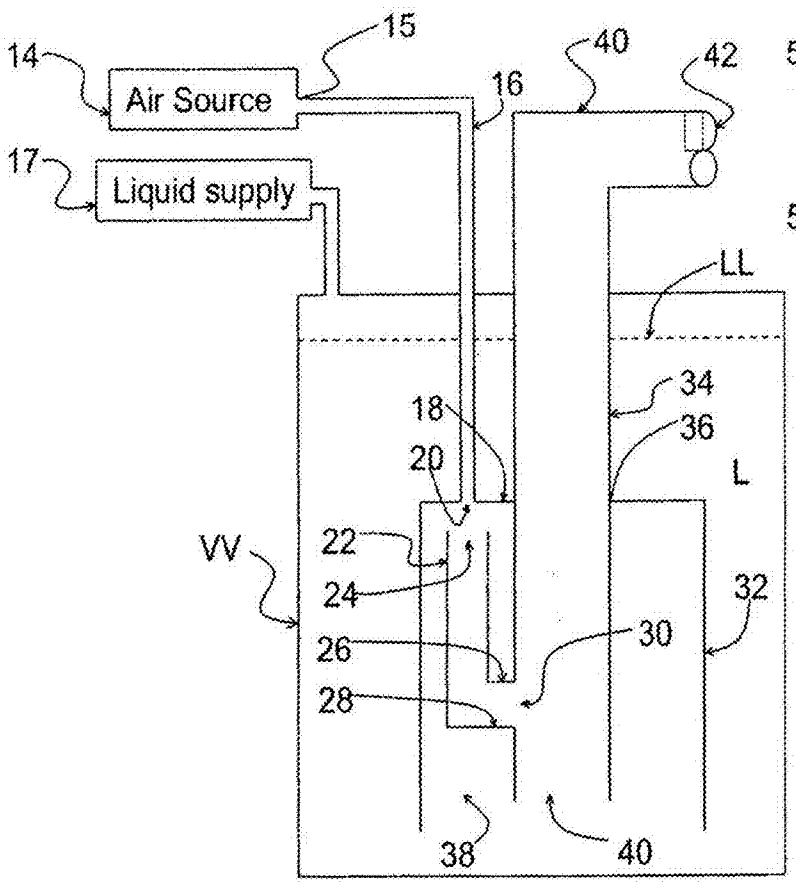
FIG. 2 PRIOR ART
FIG. 2 is a schematic representation of another conventional pump system.
Figure 8:
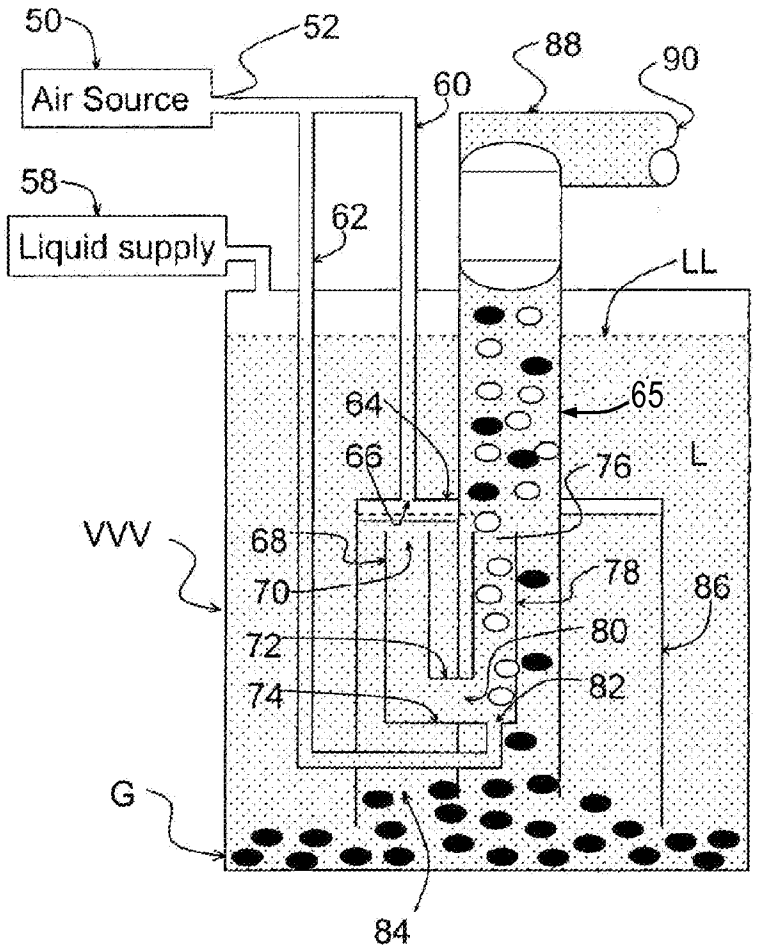
FIG. 8 is a schematic representation of the example pump system of FIG. 3 under still another operating condition.
Figure 9:
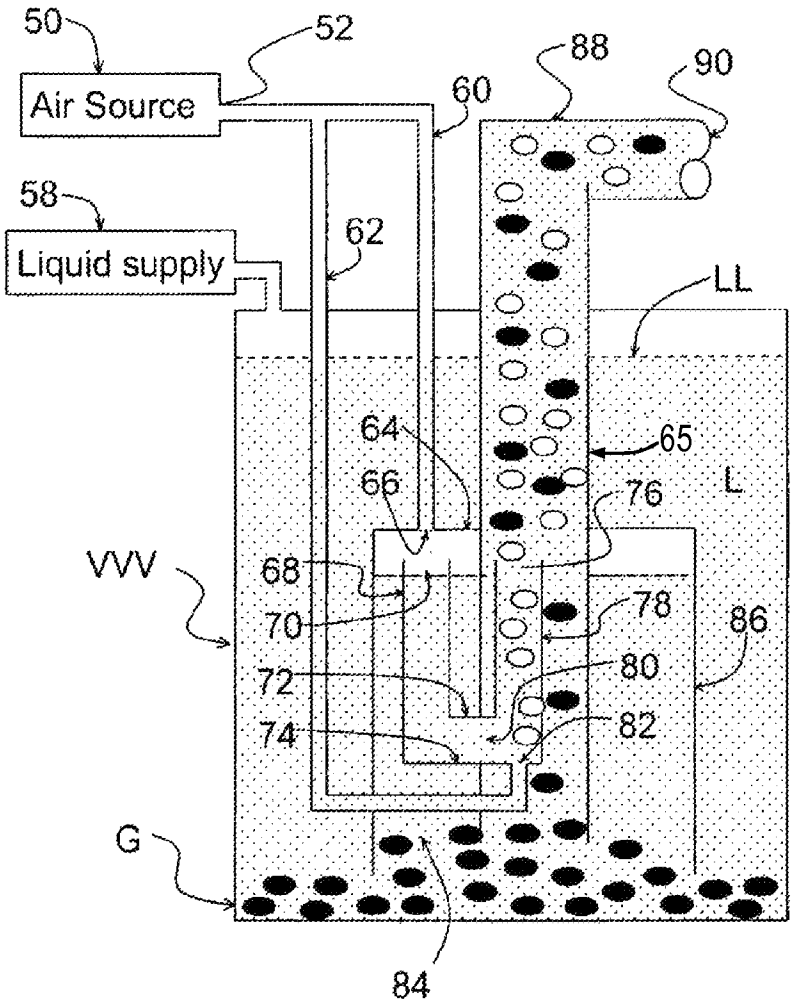
FIG. 9 is a schematic representation of the example pump system of FIG. 3 under yet another operating condition.

The liquid level may then rise in the air tank 86 at the speed of up to 2 feet per second creating a large suction pulling the grit upward with the large bubble (FIG. 8). This large suction is an increase over the conventional systems of FIGS. 1 and 2. FIG. 9 shows the airlift pump system 88 continuously transferring grit upward in the wake of the large bubble.

With reference again to FIGS. 5 through 9 together, the foregoing discussion will be summarized to describe the operation of airlift pump system 88. Initially, vessel VVV, air tank 86, U-shaped elbow 74 and riser tube 65 contain liquid L (FIG. 5). The air flowing through first supply line 60 urges a first portion of the liquid L out of air tank 86, an accumulation of air forming an air bubble in the air tank (FIG. 6). Air flowing from second supply line 62 creates a series of air bubbles within the riser tube 65 (FIG. 6). The air bubble in air tank 86 is urged through the U-shaped elbow 74 and into riser tube 65 (FIG. 7). The air bubble moves upwardly through the riser tube 65 and out of discharge port 90. A second portion of liquid L in riser tube 65 is also urged upwardly and out of discharge port 90 by the upward movement of the air bubble (FIG. 7). In addition, a third portion of liquid L is drawn through the bottom end 84 of air tank 86, through an inlet of riser tube 65, and out of the discharge port 90 due to suction in the riser tube caused by the upward movement of the air bubble (FIGS. 8 and 9). Vessel VVV, air tank 86, U-shaped elbow 74 and riser tube 65 are also replenished with liquid L (FIG. 9).

Figure 4:
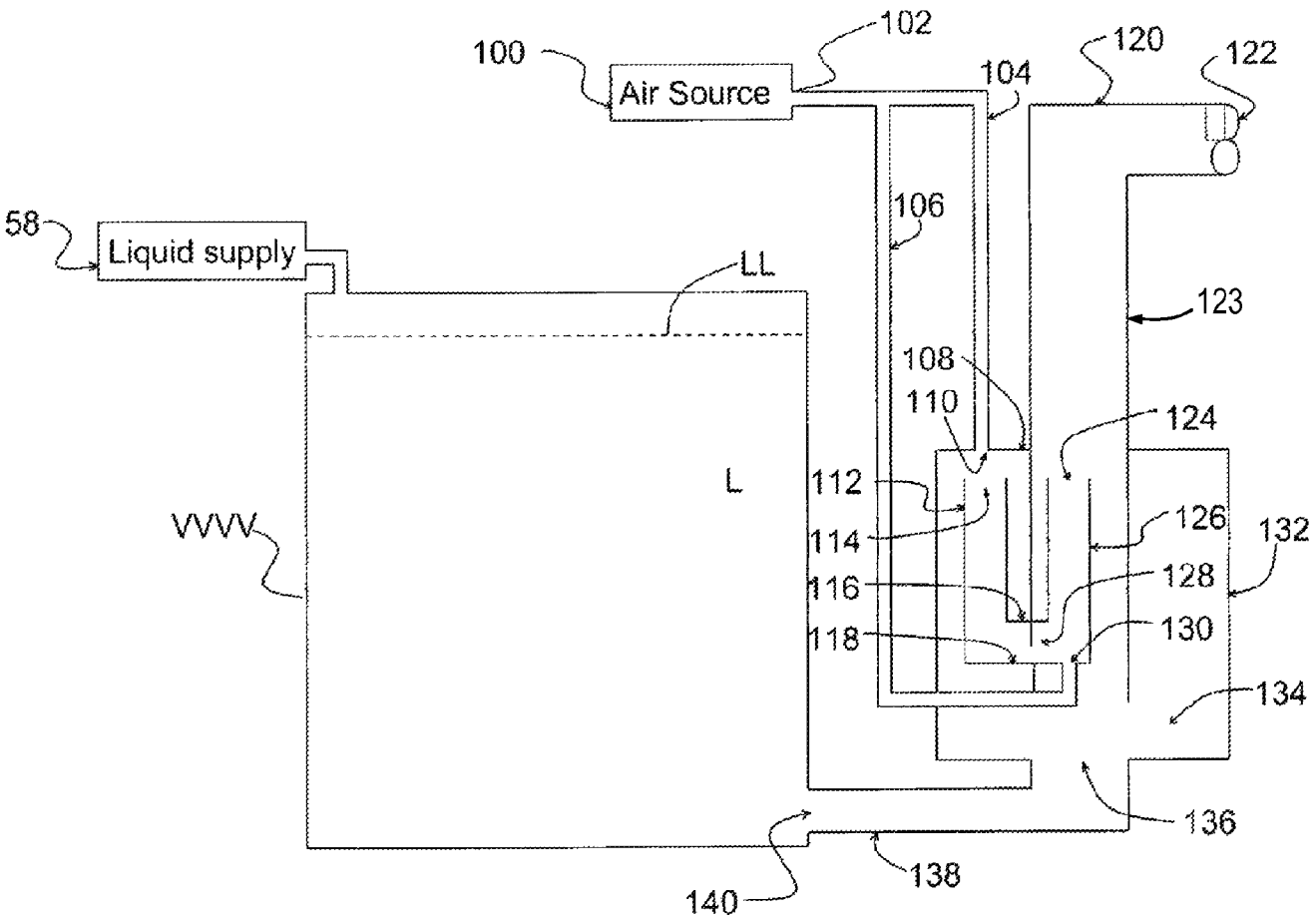
FIG. 4 is a schematic representation of the example pump system of FIG. 3 installed under a different condition.

With reference to FIG. 4, another airlift pump system 120 includes a vessel VVVV supplied with liquid from a liquid supply 58. The vessel VVVV supplies liquid to an air tank 132 from a vessel discharge port 140 through a discharge tube 138 to an intake port 136 of the air tank. The air tank 132 is supplied with air from an air source 100 connected to an input 102 of a first air supply line 104 and a second air supply line 106. A first output port 110 of the first air supply line 104 is connected to a closed upper end 108 of an air tank 132. The air tank 132 has a cylindrical configuration with a closed bottom end 134. A cylindrical riser tube 123 has a U-shaped elbow 118 with an upper vertical intake end 112 and an intake port 114, a lower horizontal portion 116 defining a port 128 penetrating a side wall of the riser tube 123, and an upper vertical discharge end 126 with a discharge port 124 disposed within the riser tube 123. A second output port 130 of the second air supply line 106 is connected to the lower horizontal portion 116 of the riser tube 123. Note that the second air supply line 106 may be omitted if the superficial density of the liquid L is less than 1.5. The riser tube 123 extends upward through a suitably tight opening in the closed upper end 108 of the air tank 132 to a discharge port 122. The airlift pump system 120 provides the increased suction advantages as described above regarding the airlift pump system 88.

It will be understood that the above description of the present invention is susceptible to various modifications, changes and adaptations, and the same are intended to be comprehended within the meaning and range of equivalents of the appended claims. The presently disclosed example embodiments are considered in all respects to be illustrative, and not restrictive. The scope of the invention is indicated by the appended claims, rather than the foregoing description, and all changes that come within the meaning and range of equivalence thereof are intended to be embraced therein.

Having described the invention, the following is claimed:

1. A system for pumping liquid, said system comprising:

a compressed air source; and a pump for vertically moving the liquid upward in intermittent pumping cycles, said pump being powered solely by said compressed air source, said pump including a first container having a closed upper end and an opposing bottom end, the opposing bottom end being in communication with the liquid, a second container having a discharge port and an opposing inlet, the opposing inlet being in communication with the liquid, and a U-shaped tube disposed interior to said first and second containers, the U-shaped tube having two upper open ends, a first portion of said U-shaped tube extending vertically downward, a second portion extending horizontally through a side wall of said second container, and a third portion extending upward interior to said second container, and a supply line extending between the compressed air source and the U-shaped tube, the supply line being coupled to the U-shaped tube such that compressed air from the supply line travels upward through the third portion of the U-shaped tube in the form of a series of air bubbles, said compressed air source supplying compressed air to the first container through the closed upper end such that during each pumping cycle:

the compressed air urges a first portion of the liquid out of the first container, an accumulation of compressed air forming an air bubble in the first container, the air bubble being urged through the U-shaped tube and into the second container, the air bubble moving upward through the second container and out the discharge port, a second portion of liquid being urged upward in the second container and out of the discharge port by the upward movement of the air bubble, and a third portion of liquid being drawn through the opposing inlet of the second container and out of the discharge port by the upward movement of the air bubble, the first container, U-shaped tube and second container each being replenished with liquid at the conclusion of each pumping cycle.

2. The system of claim 1, further comprising a vessel to contain the liquid, the pump being disposed in the vessel.

3. The system of claim 2, further including a liquid supply in communication with the vessel.

4. The system of claim 1 wherein the first container is cylindrical.

5. The system of claim 1 wherein the second container is cylindrical.

6. The system of claim 1 wherein the second container is disposed interior to the first container and extends through the closed upper end.

7. A system for pumping liquid, comprising:

a compressed air source;

a vessel for containing the liquid;

a pump for vertically moving the liquid upward in intermittent pumping cycles, the pump being powered solely by the compressed air source, the pump including:

a first container having a closed upper end and an opposing closed bottom end, a second container having a discharge port and an opposing inlet, the opposing inlet being in communication with the first container, and a U-shaped tube disposed interior to the first and second containers, the U-shaped tube having two upper open ends, a first portion of the U-shaped tube extending vertically downward, a second portion extending horizontally through a side wall of the second container, and a third portion extending upward interior to the second container;

a supply line extending between the compressed air source and the U-shaped tube, the supply line being coupled to the U-shaped tube such that compressed air from the supply line travels upward through the third portion of the U-shaped tube in the form of a series of air bubbles; and a vessel discharge tube extending between the vessel and the first container, liquid in the vessel being in communication with the first container through the vessel discharge tube, the compressed air source supplying compressed air to the first container through the closed upper end such that during each pumping cycle:

the compressed air urges a first portion of the liquid out of the first container, an accumulation of compressed air forming an air bubble in the first container, the air bubble being urged through the U-shaped tube and into the second container, the air bubble moving upward through the second container and out the discharge port, a second portion of liquid being urged upward in the second container and out of the discharge port by the upward movement of the air bubble, and a third portion of liquid being drawn through the opposing inlet of the second container and out of the discharge port by the upward movement of the air bubble, the first container, U-shaped tube and second container each being replenished with liquid at the conclusion of each pumping cycle.

8. The system of claim 7, further including a liquid supply in communication with the vessel.

9. The system of claim 7 wherein the first container is cylindrical.

10. The system of claim 7 wherein the second container is cylindrical.

11. The system of claim 7 wherein the second container is disposed interior to the first container and extends through the closed upper end.

12. The system of claim 7 wherein the vessel discharge tube is coupled to the bottom end of the first container.

* * * * *